United States Patent [19]

Graham

[11] Patent Number: 4,635,046

[45] Date of Patent: Jan. 6, 1987

[54] WIRE TANGLE SENSOR

[75] Inventor: Randall C. Graham, Nashville, Tenn.

[73] Assignee: Essex Group, Inc., Fort Wayne, Ind.

[21] Appl. No.: 788,901

[22] Filed: Oct. 18, 1985

[51] Int. Cl.[4] ..... G08B 21/00

[52] U.S. Cl. ..... 340/677; 340/650

[58] Field of Search ..... 340/677, 540, 650–651, 340/649, 652; 200/61.13–61.18; 28/227, 231; 19/0.22–0.23; 242/36; 324/52–54, 509, 513, 543–544, 556

[56] References Cited

U.S. PATENT DOCUMENTS

| | | | |
|---|---|---|---|
| 2,950,520 | 8/1960 | Sonnino | 19/0.23 X |
| 3,611,342 | 10/1971 | Dieren et al. | 340/677 |
| 3,842,668 | 10/1974 | Lippke | 200/61.13 X |
| 4,007,457 | 2/1977 | Aeppli | 19/0.23 X |
| 4,060,965 | 12/1977 | Schwartz | 340/677 X |
| 4,184,769 | 1/1980 | Aeppli | 66/163 X |
| 4,311,958 | 1/1982 | Aeppli | 28/227 X |
| 4,512,526 | 4/1985 | Tone et al. | 242/36 |

*Primary Examiner*—Glen R. Swann, III
*Assistant Examiner*—Thomas J. Mullen, Jr.
*Attorney, Agent, or Firm*—Francis J. Maguire, Jr.

[57] ABSTRACT

A wire tangle sensor is disclosed for sensing tangled wire in a wire fabrication process prior to being fed into a wire drawing machine so that a tangled wire signal may be sent to a verbal annunciator. A verbal announcement of a tangled wire condition is made for immediate corrective action by maintenance personnel to avoid a production shutdown. The wire tangle sensor comprises a metallic probe positioned in close proximity to a moving wire which touches the wire when it becomes tangled thereby grounding the probe and providing a current path for a switch which initiates the verbal announcement.

2 Claims, 4 Drawing Figures

WIRE TANGLE SENSOR

CROSS REFERENCES TO RELATED APPLICATIONS

The invention described herein may employ some of the teachings disclosed and claimed in commonly owned co-pending applications filed on even date herewith by Graham, Ser. No. 788,990, entitled LOW COST VERBAL ANNUNCIATOR, Ser. No. 788,902, entitled A WIRE BREAK SENSOR, Ser. No. 788,903, entitled A WIRE RUNTOGETHER SENSOR, and Ser. No. 788,904, entitled A DRY LUBE LEVEL SENSOR. Each of the above listed co-pending applications are hereby expressly incorporated by reference.

TECHNICAL FIELD

This invention relates to process alarm systems and particularly to a wire tangle sensor for use with a verbal annunciator system.

BACKGROUND ART

Modern wire manufacturing processes often require fast response and quick corrective action to prevent production delays. For example, recently developed high speed wire manufacturing processes in which a heavy gage wire is drawn down to a smaller size, e.g., #12 AWG to #22 AWG, can experience faults which, if not rapidly corrected, can cause expensive production shutdowns. Factories for making such wire may consist of a large number of such production units spread over a wide expanse and staffed only by a small number of maintenance personnel on an around the clock basis. Unfortunately, present alarming systems for detecting faults and producing audio and visual alarms are sometimes inadequate in providing sufficient information to immediately direct the maintenance personnel to the source of the problem in time to prevent production shutdowns.

In co-pending application Ser. No. 788,990, a LOW COST VERBAL ANNUNCIATOR having the same inventive entity and assignee as the present application, is disclosed. Several unique sensors developed for use with that annunciator are disclosed in that application. Included among those unique sensors is the wire tangle sensor which is claimed in this application.

DISCLOSURE OF THE INVENTION

The object of the present invention is to provide a simple and inexpensive wire tangle sensor.

According to the present invention, a tangle sensor for sensing tangled wires fed from a wire basket into a wire drawing machine comprises a metallic probe for placement in close proximity to wire payed out from a basket for touching any tangled wire which may be payed out from the basket in a tangled manner. The metallic probe is connected to a switch which provides a two-state output signal indicative of a tangled wire condition in the presence of a tangled wire touching the metallic probe. The switch means may be a relay, a transistor, or any of the well known switches in the electronics art.

In further accord with the present invention, the tangle sensor is used with a central monitoring and control panel which includes a plurality of cassette players, one for each sensed condition, for providing verbal message signals corresponding to abnormal sensed conditions. The signals are provided to a power amplifier and speaker for announcement to maintenance personnel for rapid response and corrective action.

Wires payed out in a tangled manner from a basket into a wire drawing machine will cause a shutdown of the wire production line. The present invention provides a simple and inexpensive means of early detection of a tangled wire well before entrance into a drawing machine. Since each coil of wire in each basket is grounded, the touching of a tangled wire to a probe provides a ground path for actuating a switch which provides a binary output signal to the central monitoring unit which in turn provides a verbal annunciation to the maintenance personnel. In this way, the down time of a wire manufacturing process is minimized by immediately indentifying the source of a potential problem which may be quickly corrected before causing a production shutdown. The use of a tangle sensor with a verbal annunciator provides an extremely inexpensive and effective method of reducing unplanned shutdowns in a wire manufacturing plant.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1:
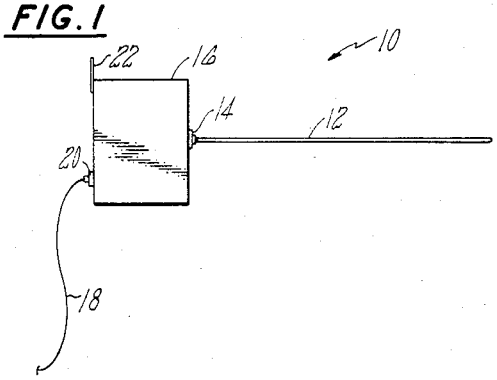
FIG. 1 is a side view of a tangle sensor, according to the present invention.

FIG. 1 is an illustration of a tangle sensor 10, according to the present invention. A long metallic probe 12 is attached by means of a stuffing tube 14 or other suitable attachment means to a housing 16 for holding the probe in a desired position with respect to payed out wire. A signal lead 18 emerges from another stuffing tube 20 in the housing 16 which is ultimately connected up to a central monitoring and control panel.

The housing 16 may include bracket means 22 for attachment to a suitable foundation for proper positioning of the probe 12.

During normal operation of the wire tangle sensor 10, the probe will be in close proximity to a moving wire payed out from a coil. The wire will usually be payed out in a straight manner so that the wire will not touch the metallic probe. However, if the payed out wire becomes tangled it will momentarily touch the probe 12 and, since the payed out wire is grounded, the metallic probe 12 will also be momentarily grounded.

Figure 2:
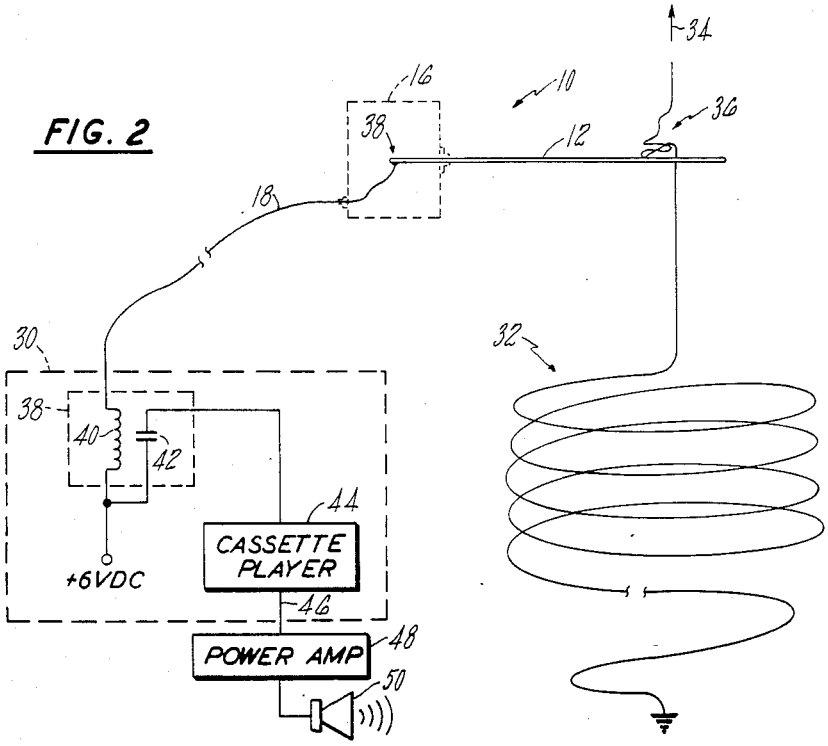
FIG. 2 is a simplified schematic block diagram illustration of a tangle sensor for use with a central monitoring and control panel, according to the present invention.

FIG. 2 is a more detailed illustration of the sensor of FIG. 1 connected up to a central monitoring and control panel 30. A coil of wire 32 which may be of a very great length is shown being payed out in the direction of at arrow 34. Normally, the wire is payed out in a straight manner but a tangle is shown at 36 touching the metallic probe 12. This causes the probe to be grounded, since the coil 32 is grounded. The end 38 of the probe 12 is connected to the sensing lead 18 which is attached at its other end to a relay 38. The wire 18 is shown having a break therein to indicate that where may be a considerable distance between the sensor 10 and central monitor 30. The momentary grounding of the probe 12 causes current to be conducted in a relay coil 40 which causes a related contact 42 to close. This energizes the drive motor of a cassette player 44 which provides an alarm signal on a line 46 to a power amplifier 48. A speaker 50 provides an acoustic announcement of a verbal message. For example, the annunciated message might be "Tangled Wire At Basket 102."

Figure 3:
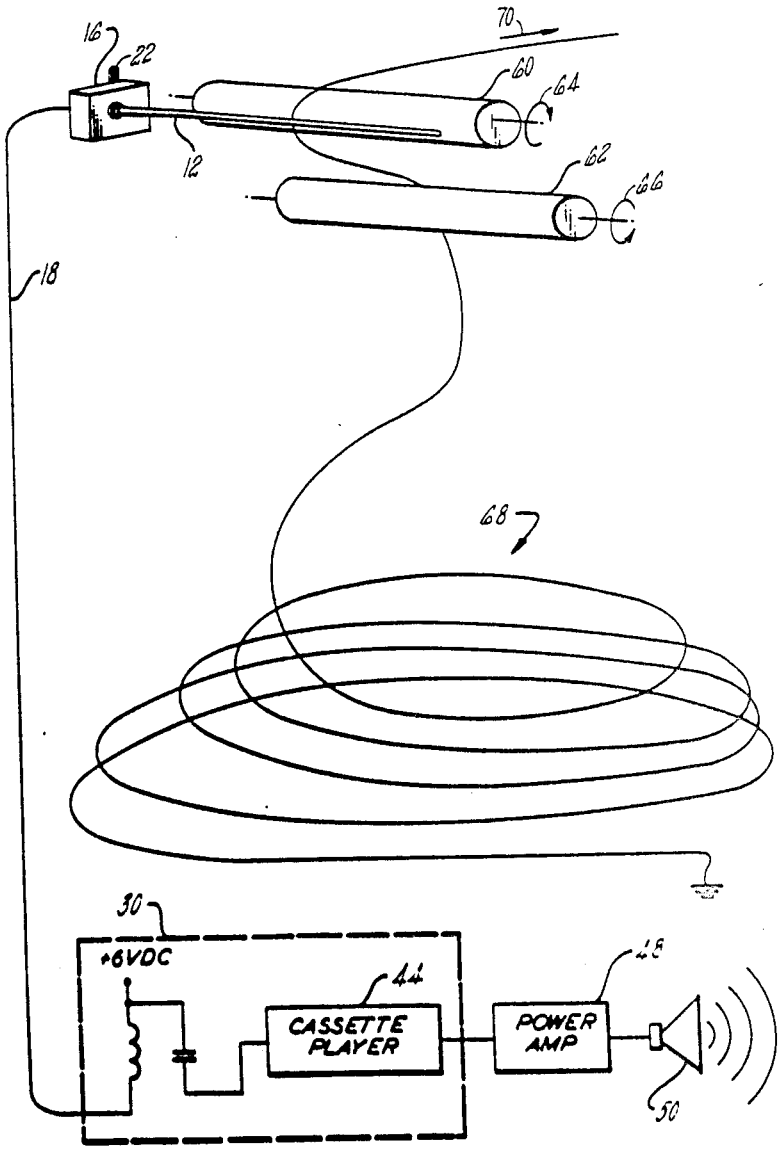
FIG. 3 is a perspective illustration of a wire tangle sensor shown adjacent to a pair of wire rollers, the sensor being connected to a central monitoring and control panel for annunciation of verbal messages.

FIG. 3 is a perspective illustration of a tangle sensor 10 used with a pair of rollers 60, 62 rotating in the directions shown by the arrows 64, 66, respectively. A coil of wire 68 is payed out in the direction shown by an arrow 70 through the rollers and past the probe. The probe is mounted in the housing 16 and the sensing lead 18 provides a tangle signal to the monitoring panel 30, as before. Similarly, the cassette player 44, power amplifier 48, and speaker 50 are the same as in FIG. 2.

Figure 4:
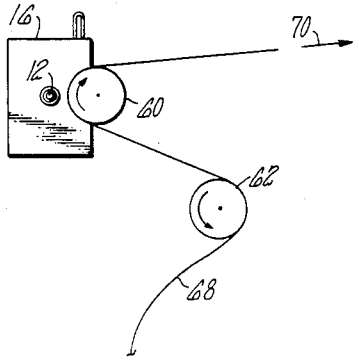
FIG. 4 is a side view of the probe and rollers of FIG. 3.

FIG. 4 is a side view of the rollers 60, 62 and probe 12 of FIG. 3 showing a particular selected positioning of the rollers and showing the positioning of the probe with respect to roller 60. The rollers may be positioned with the lower roller positioned obliquely with respect to the upper roller as shown. In that event, the positioning of the probe can be as shown in FIG. 4. However, it will be understood that many other variations of the probe sensor with respect to a pair of rollers can be contemplated within the scope of the invention. For example, the probe 12 could be positioned near roller 62 instead of roller 60. Or, there could be no rollers at all but some other means of feeding wire by the probe.

Although the invention has been shown and described with respect to illustrated embodiments thereof, it should be understood by those skilled in the art that the foregoing and various other changes, omissions, and additions in the form and detail thereof may be made therein without departing from the spirit and scope of the invention.

I claim:

1. A wire tangle sensor, comprising:

an elongated metallic probe for placement in close proximity to grounded wire payed out from a coil in a basket, said probe for touching tangled wire, said touching causing the grounding of said probe; and signalling means, connected to said probe, responsive to said touching of said metallic probe to a tangled wire for causing a current to be conducted through said probe and said grounded wire and for providing a tangle signal indicative of a tangled wire condition.

2. A wire tangle sensor, for use with a verbal annunciator actuated by a signalling means, comprising:

a pair of elongated guide rollers for positioning above a basket of grounded wire for guiding wire payed out from the basket; and an elongated metallic probe for connection to the signalling means and for placement parallel to said elongated guide rollers in close proximity to payed out wire guided by said guide rollers, for touching a tangle in wire which is payed out from the basket in a tangled manner thereby grounding the probe to actuate the signalling means for causing actuation of the verbal annunciator.

* * * * *